US010023376B2

(12) United States Patent
Slooff

(10) Patent No.: US 10,023,376 B2
(45) Date of Patent: Jul. 17, 2018

(54) CONTAINER WITH WRAPPER WITH REMOVABLE PORTION

(71) Applicant: PHILIP MORRIS PRODUCTS S.A., Neuchatel (CH)

(72) Inventor: Arjen Hamilcar Slooff, Rhenen (NL)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/326,822

(22) PCT Filed: Aug. 28, 2015

(86) PCT No.: PCT/EP2015/069778
§ 371 (c)(1),
(2) Date: Jan. 17, 2017

(87) PCT Pub. No.: WO2016/030520
PCT Pub. Date: Mar. 3, 2016

(65) Prior Publication Data

US 2017/0197778 A1 Jul. 13, 2017

(30) Foreign Application Priority Data

Aug. 29, 2014 (EP) ..... 14182951

(51) Int. Cl.
*B65D 85/28* (2006.01)
*B65D 85/10* (2006.01)
(Continued)

(52) U.S. Cl.
CPC ..... *B65D 85/1081* (2013.01); *A24F 15/00* (2013.01); *B65D 65/02* (2013.01);
(Continued)

(58) Field of Classification Search
USPC ..... 206/242, 271, 273, 264, 265, 459.5
See application file for complete search history.

(56) References Cited

U.S. PATENT DOCUMENTS 4,746,012 A * 5/1988 Simard ..... B65D 85/1009 206/254
4,916,884 A 4/1990 Focke
(Continued)

FOREIGN PATENT DOCUMENTS

CN 86105075 3/1987
CN 1087061 5/1994
(Continued)

OTHER PUBLICATIONS

PCT Search Report and Written Opinion for PCT/EP2015/069778 dated Oct. 20, 2015 (9 pages).
(Continued)

*Primary Examiner* — Jacob K Ackun
(74) *Attorney, Agent, or Firm* — Mueting, Raasch & Gebhardt, P.A.

(57) ABSTRACT

A container of consumer goods (18) comprises a housing (10) comprising a box (12) and a lid (14) closing the box. The consumer goods are wrapped in a wrapper (20) and contained within the housing (10), the wrapper (20) being partially exposed when the lid (14) is open and having a removable portion (22) that can be removed when the lid (14) is open to expose the consumer goods (18). The removable portion (22) of the wrapper (20) has a first part that is visible when the lid (14) is open and a second part that underlies one or more walls of the box (12) and is not visible when the lid (14) is open and the second part of the removable portion (22) of the wrapper (20) carries one or more indicia that are visually distinct from the part of the wrapper (20) that is exposed when the lid (14) is open.

20 Claims, 1 Drawing Sheet

Figure 1B:
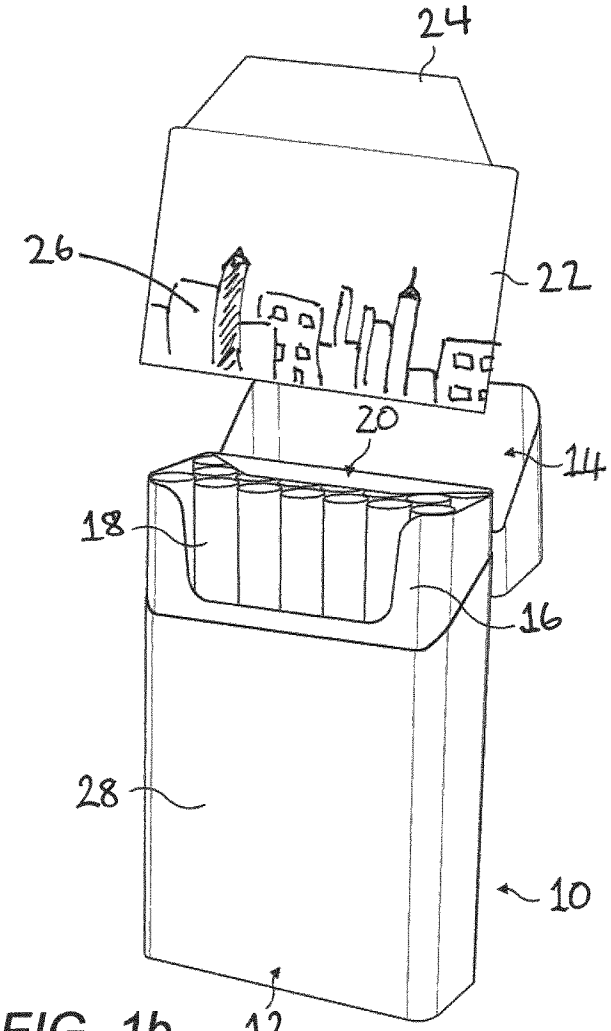

(51) Int. Cl.

| | |
|---|---|
| ***A24F 15/00*** | (2006.01) |
| ***B65D 65/02*** | (2006.01) |
| ***B65D 77/04*** | (2006.01) |
| ***B65D 77/38*** | (2006.01) |

(52) U.S. Cl.
CPC ..... *B65D 77/04* (2013.01); *B65D 77/38* (2013.01); *B65D 85/1045* (2013.01)

(56) References Cited

U.S. PATENT DOCUMENTS

| | | | | |
|---|---|---|---|---|
| 4,942,961 | A | 7/1990 | Focke | |
| 5,137,148 | A * | 8/1992 | Evers | B65D 5/4233 206/271 |
| 5,178,272 | A * | 1/1993 | Evers | B65D 5/4233 206/264 |
| 5,465,837 | A | 11/1995 | Focke | |
| 7,896,225 | B2 * | 3/2011 | Bray | B65D 85/1063 206/242 |
| 2003/0164314 | A1 * | 9/2003 | Bray | B65D 75/5838 206/264 |
| 2005/0247583 | A1 * | 11/2005 | Koetter | B65D 85/1018 206/242 |
| 2010/0155274 | A1 * | 6/2010 | de The | B31F 1/07 206/271 |

FOREIGN PATENT DOCUMENTS

| | | |
|---|---|---|
| CN | 1215021 | 4/1999 |
| EP | 0476882 | 3/1992 |
| EP | 2000423 | 12/2008 |
| EP | 2471725 | * 4/2012 |
| WO | WO 2007/059820 | 5/2007 |

OTHER PUBLICATIONS

Office Action issued in China for Application No. 201580043712.4 dated Apr. 2, 2018 (16 pages). English translation included.

* cited by examiner

CONTAINER WITH WRAPPER WITH REMOVABLE PORTION

This application is a U.S. National Stage Application of International Application No. PCT/EP2015/069778, filed Aug. 28, 2015, which was published in English on Mar. 3, 2016 as International Publication No. WO 2016/030520 A1. International Application No. PCT/EP2015/069778 claims priority to European Application No. 14182951.5 filed Aug. 29, 2014.

The present invention relates to a container of consumer goods containing one or more consumer goods wrapped in a wrapper. The invention finds particular application as a pack smoking articles such as cigarettes.

Smoking articles such as cigarettes and cigars are commonly packaged in rigid hinge-lid containers having a box and a lid connected to the box about a hinge line extending across the back wall of the container. Such hinge-lid containers are typically constructed from one-piece laminar cardboard blanks. In use, the lid is pivoted about the hinge line to open the container and so gain access to a bundle of smoking articles housed in the box.

The bundle of smoking articles housed in the box is typically wrapped in an inner liner of metallised paper, metal foil or other flexible sheet material. The inner liner is typically a rectangular sheet of material folded around the bundle of smoking articles and then folded closed at the top and bottom ends, for example, using an envelope fold. The inner liner of some known containers of smoking articles and other consumer goods can be used to carry information to the consumer. For example, it is known to emboss or print some inner liners with brand information.

To access the bundle of smoking articles within the inner liner, upon first opening the hinge-lid container a consumer can unfold a top portion of the inner liner to expose the smoking articles. Alternatively, some inner liners are provided with a detachable upper portion, which a consumer can remove and discard to access the smoking articles. However, the detachable portion of such inner liners is typically relatively small in size, with a relatively plain shape and appearance. Consequently, these detachable tab portions currently have little utility beyond the function of allowing a consumer access to the contents of the container.

It would be desirable to provide a novel wrapper arrangement for a wrapped bundle of consumer goods such as smoking articles, wherein the wrapper is adapted to provide improved means for communicating with the consumer.

According to one aspect of the present invention, there is provided a container of consumer goods comprising a housing comprising a box and a lid closing the box and one or more consumer goods wrapped in a wrapper and contained within the housing, the wrapper being partially exposed when the lid is open and having a removable portion that can be removed when the lid is open to expose the consumer goods, the removable portion of the wrapper having a first part that is visible when the lid is open and a second part that underlies one or more walls of the box and is not visible when the lid is open, wherein the second part of the removable portion of the wrapper carries one or more indicia that are visually distinct from the part of the wrapper that is exposed when the lid is open.

The one or more indicia on the second part of the wrapper may be one or more abstract or figurative pictures, coloured patterns, type font, text, logos, combinations of these or any other indicia.

The one or more indicia on the second part of the wrapper are visually distinct from the part of the wrapper that is exposed when the lid is open. That is, if the first part of the wrapper carries one or more indicia, then the one or more indicia on the second part of the wrapper are visually distinct, that is, different from these. Alternatively, the first part of the wrapper may carry no indicia, in which case the one or more indicia on the second part of the wrapper will be visually distinct from the part of the wrapper that is exposed when the lid is open. In this way, the one or more indicia that are carried by the second part of the wrapper are only first revealed and visible to the consumer when the consumer initially removes the removable portion of the wrapper.

Some or all of the first part of the removable portion of the wrapper (the part that is visible on first opening the housing lid) or some or all of the other parts of the wrapper that are visible on opening the housing lid, may or may not carry indicia; if they do, those indicia are visually distinct from the one or more indicia on the second part of the removable portion of the wrapper. For example, the parts of the wrapper that are visible upon opening the container may carry a repeating pattern of brand information, such as a repeating logo, while the second part of the removable portion of the wrapper carries a picture of, for example, a landscape or an animal or the first part may carry a picture and the second part may carry trade mark material or a different picture, and so on. Until the removable portion of the wrapper is removed from the housing, the picture will not be visible. As another example, one or more parts of the wrapper that are visible upon opening the housing lid may carry a portion of an overall indicia, with another portion of the overall indicia being carried by the second part of the removable portion of the wrapper. This means that when the removable portion of the wrapper is removed from the housing the overall indicia can be revealed to a consumer.

In some embodiments of the invention the lid extends from the box along a hinge line across a back wall of the housing, wherein the lid is moveable between an open position and a closed position in which a front wall of the lid and a front wall of the box together define a front wall of the housing opposite the back wall of the housing.

In some embodiments the area of the second part of the removable portion of the wrapper is preferably at least 10 percent of the area of the removable portion of the wrapper, more preferably at least 20 percent of the area of the removable portion of the wrapper, and even more preferably at least 30 percent of the area of the removable portion of the wrapper. In this way, the second portion of the wrapper can be reliably located in a non-visible portion of the container when the lid is in an open position, within the tolerance levels expected of standard manufacturing machinery.

In some embodiments the removable portion of the wrapper is integral with the rest of the wrapper and is detached therefrom for removal. For example, the removable portion of the wrapper may be defined by a line of weakness such as a line of perforations in the wrapper. In other embodiments, the removable portion of the wrapper is a separate sheet from the rest of the wrapper.

In some embodiments the removable portion of the wrapper preferably comprises a front panel and at least 20 percent of the area of the front panel of the removable portion of the wrapper underlies a front wall of the box, more preferably at least at least 40 percent of the area of the front panel of the removable portion of the wrapper underlies a front wall of the box, and even more preferably at least 60 percent of the area of the front panel of the removable portion of the wrapper underlies a front wall of the box.

In some embodiments the removable portion of the wrapper preferably comprises a front panel and the height of the front panel of the removable portion corresponds to at least 30 percent of the height of the housing, more preferably to at least 40 percent of the height of the housing, and even more preferably to at least 50 percent of the height of the housing.

In some embodiments the removable portion of the wrapper comprises at least one side panel extending from a front panel, in which at least 50 percent of the or each side tab panel of the removable portion underlies a respective side wall of the box portion to provide a part of the first part of the removable portion of the wrapper. Alternatively or additionally, the removable portion of the wrapper may include a top panel extending from the front panel.

In some embodiments the one or more consumer goods is a plurality of smoking articles.

In use, the user of the container opens the lid and removes the removable portion of the wrapper to expose the consumer goods in the container. The one or more indicia on the second part of the removable portion of the wrapper (the part that cannot be seen until the removable portion is removed from the housing) are thereby exposed and are visible to the user for the first time.

The wrapper may be of any suitable flexible laminar material including but not limited to metal foil, a laminate of metal foil and paper, metallised paper, metallised polymer film, polymer film and paper.

The indicia may be applied to the wrapper by printing, embossing, impression or otherwise or by any combination thereor. However, preferably, the indicia are applied to the wrapper by printing.

The container may be of any suitable material, including but not limited to card, cardboard, paperboard, plastic, metal and combinations thereof.

The one or more consumer goods may be a plurality of cigarettes or other smoking articles.

In the present specification, the terms 'front', 'rear', 'side', ' top', 'bottom', 'upper', 'lower', 'above' and 'behind' refer to a container in its conventional upright position; in the case of a pack of cigarettes, the cigarettes in the pack are typically upright in this position.

The container may be a hinge lid pack for cigarettes or other smoking articles. Hinge lid cigarette packs are well known. A hinge lid pack comprises a pack body having opposed front and rear walls connected to each other by opposed side walls to form a pack of, typically, rectangular or generally rectangular section. A lid, also having opposed front and rear walls connected to each other by opposed side walls extends from and is hingedly connected to the rear wall of the pack body, and an inner frame disposed inside the pack body. The inner frame lies behind the front wall of the pack body and extends above the top edge of the front wall; the lid closes onto the inner frame, the lower front edge of the lid meeting the upper front edge of the pack body.

A hinge lid pack is typically formed from a card blank folded around a bundle of smoking articles wrapped in a wrapper, or inner liner, of a laminar material such as metal foil or a laminate of metal foil and paper. The wrapper is folded around the rear, bottom and front of a bundle of smoking articles, around the sides of the bundle and is closed at the top of the bundle by an envelope fold. The bundle of cigarettes or other smoking articles typically contains ten or twenty smoking articles. The smoking articles may be arranged in different collations, depending on the total number of smoking articles. For example, the smoking articles may be arranged in a single row of five, six, seven, eight, nine or ten. Alternatively, the smoking articles may be arranged in two or more rows. Smoking articles in one row may lie partially between smoking articles in an adjacent row. The two or more rows may contain the same number of smoking articles. For example, the smoking articles may be collated in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7). Typically, the outer rows of a bundle are adjacent the front and rear walls, respectively, of the container.

Containers of smoking articles according to the present invention may hold smoking articles of the same type or brand, or of different types or brands. The smoking articles in the container may be filterless smoking articles or smoking articles with a filter tip or both. The smoking articles may all be of the same different lengths (for example, between about 40 mm and about 180 mm) and of the same or different diameter (for example, between about 4 mm and about 9 mm). In addition, the smoking articles may differ in strength of taste, resistance to draw and total particulate matter delivery. Preferably, the dimensions of the wrapped bundles and the containers are adapted to the length and diameter of the smoking articles, and the collation of the smoking articles. Typically, the outer dimensions of the container are between about 0.5 mm to about 5 mm larger than the dimensions of the wrapped bundle or bundles of smoking articles housed inside the container.

Preferably, containers according to the invention can have a height of between about 60 mm (millimeters) and about 150 mm, more preferably a height of between about 70 mm and about 125 mm, the height being measured from the bottom wall to the top wall of the container. In some embodiments, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container (comprising the hinge between box and lid).

Preferably, the ratio of the height of the container to the depth of the container is between about 0.3:1 and about 10:1, more preferably between about 2:1 and about 8:1, most preferably between about 3:1 and 5:1

Preferably, the ratio of the width of the container to the depth of the container is between about 0.3:1 and about 10:1, more preferably between about 2:1 and about 8:1, most preferably between about 2:1 and 3:1.

Preferably, the ratio of the height of the lid back wall to the height of the box back wall is between about 0 (the lid is hinged at the top edge of the container) and about 1:1, more preferably, between about 1:5 and about 1:10, most preferably, between about 1:6 to about 1:8.

Preferably, the ratio of the height of the lid front wall to the height of the box front wall is between about 0 (the lid provides the entire front face of the container) to about 1:10, more preferably, between about 1:1 and about 1:5, most preferably, between about 1:2 and about 1:3.

Where the wrapped bundle houses smoking articles, the container may further comprise waste-compartments (for example for ash or butts) or other consumer goods, for example matches, lighters, extinguishing means, breath-fresheners or electronics. The other consumer goods may be attached to the outside of the container, contained within the container along with the package of smoking articles, in a separate compartment of the container or combinations thereof.

The exterior surfaces of containers according to the invention may be printed, embossed, impressed or otherwise embellished with manufacturer or brand logos, trade marks, slogans and other consumer information and indicia.

Once filled, containers according to the invention may be shrink wrapped or otherwise overwrapped with a transparent polymeric film of, for example, high or low density polyethylene, polypropylene, oriented polypropylene, polyvinylidene chloride, cellulose film, or combinations thereof in a conventional manner. Where containers according to the invention are overwrapped, the overwrap may include one or more tear tapes. In addition, the overwrap may be printed with images, consumer information or other data.

Figure 1A:
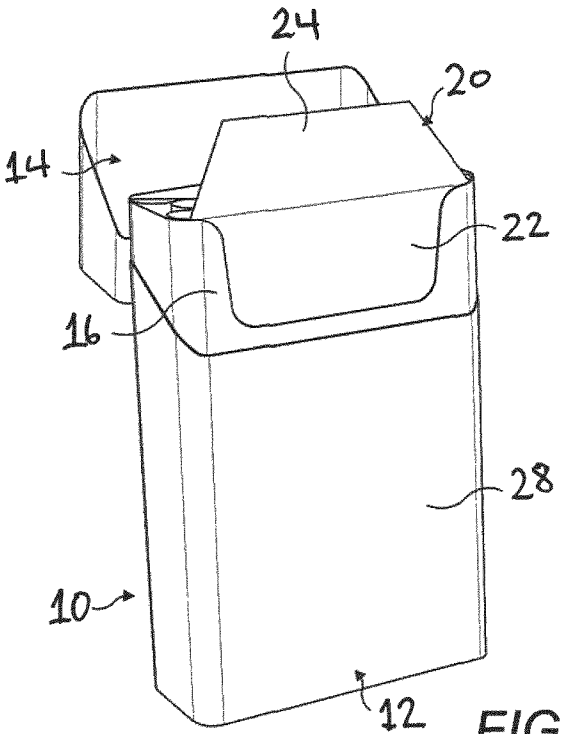

The invention will be further described by way of example with reference to the following drawings, in which:

FIGS. 1*a* and 1*b* show a container according to a first embodiment of the first aspect of the invention.

FIGS. 1*a* and 1*b* show an embodiment of the invention in the form of a hinge lid cigarette pack 10 comprising a pack body 12 to which a lid 14 is hinged along the back wall and an inner frame 16 disposed inside the pack body 12. A bundle of cigarettes 18 wrapped in an inner liner or wrapper 20 is inside the pack. The inner liner is of a laminar material such as metal foil or a laminate of metal foil and paper. The hinge lid pack 10 may be formed from a card blank. The blank is folded around a bundle of cigarettes 18 wrapped in an inner liner 20. The inner liner is folded around the bundle of cigarettes, typically ten or twenty in number, and closed at the top (as viewed in the drawings) with an envelope fold. The inner liner 20 extends partly over the sides of the bundle.

The inner liner 20 includes a removable portion 22 disposed at the front (as viewed in the drawings) of the pack so that when the pack is open, the removable portion 20 of the inner liner is visible, as shown in FIG. 1*a*.

FIG. 1*a* shows the pack 10 immediately after it has been first opened, after the outer overwrap (not shown) has been removed. The entire inner liner 20 is in place in the pack. In the embodiment shown in the figures, the part of the inner liner that is visible when the pack is first opened does not carry any indicia. In other embodiments, this part of the inner liner can carry indicia, such as trade mark material, including logos, or purely decorative material. The removable portion 22 of the liner is defined from the rest of the inner liner 20 by a line of perforations or other line of weakness (not shown). When the pack 10 is first opened, the free top edge portion 24 of the removable portion 22 of the inner liner 20, at the top end of the bundle of cigarettes, can be grasped and pulled and so detached from the rest of the inner liner and removed from the pack.

FIG. 1*b* shows the pack 10 open with the removable portion 22 of the inner liner removed. The part of the removable portion 22 that was not visible before removal carries indicia 26, in this embodiment a picture; the indicia may be of any kind, such as trade mark material, a picture or any other visual indicia, that are visually different from any indicia carried on the part of the inner wrapper 20 that is visible when pack is first opened.

As can be seen in FIG. 1*b*, in this embodiment about 50 percent of the removable portion 22 of the inner liner 20 underlies the inner frame 16 and the front wall 28 of the pack 10. This allows the removable portion 22 of the inner liner 20 to carry more information or other indicia than is the case for conventional containers. As is also seen in FIG. 1*b*, the height of the front panel of the removable portion (that is, the portion extending below the free top edge portion 24) corresponds to about 50 percent of the height of the pack.

The invention claimed is:

1. A container of consumer goods comprising:

a housing comprising a box and a lid closing the box; and one or more consumer goods wrapped in a wrapper and contained within the housing, the wrapper being partially exposed when the lid is open and having a removable portion that can be removed when the lid is open to expose the consumer goods, the removable portion of the wrapper having a first part that is visible when the lid is open and a second part that underlies one or more walls of the box and is not visible when the lid is open, wherein the second part of the removable portion of the wrapper carries one or more indicia that are visually distinct from the part of the wrapper that is exposed when the lid is open.

2. A container according to claim 1, wherein the first part of the wrapper carries one or more indicia, and wherein the one or more indicia on the second part of the wrapper are visually distinct from the one or more indicia on the first part of the wrapper.

3. A container according to claim 1, wherein one or more parts of the wrapper that are visible upon opening the housing lid carry a portion of an overall indicia, and wherein another portion of the overall indicia is carried by the second part of the removable portion of the wrapper.

4. A container according to claim 1 in which the lid extends from the box along a hinge line across a back wall of the housing, in which the lid is moveable between an open position and a closed position in which a front wall of the lid and a front wall of the box together define a front wall of the housing opposite the back wall of the housing.

5. A container according to claim 1, wherein the second part of the removable portion of the wrapper underlies a front wall of the box.

6. A container according to claim 1 in which the area of the second part of the removable portion of the wrapper is at least 10 percent of the area of the removable portion of the wrapper.

7. A container according to claim 1 in which the removable portion of the wrapper comprises a front panel and at least 20 percent of the area of the front panel of the removable portion of the wrapper underlies a front wall of the box.

8. A container according to claim 1 wherein the removable portion of the wrapper comprises a front panel and the height of the front panel of the removable tab portion corresponds to at least 30 percent of the height of the housing.

9. A container according to claim 1 wherein the one or more consumer goods is a plurality of smoking articles.

10. A container according to claim 1 in which the second part of the removable portion of the wrapper has a surface area of at least 800 square millimeters.

11. A container according to claim 1 in which the length of the second part of the removable portion of the wrapper is at least 15 percent of the length of the housing.

12. A container according to claim 1 in which the wrapper includes a line of weakness along which the removable portion of the wrapper can be detached from the rest of the wrapper.

13. A container according to claim 1 in which the box portion comprises a box front wall having a top edge that defines an edge of an opening through which consumer goods can be removed from the container when the lid is in the open position, and wherein the distance between the top edge of the box front wall and the line of weakness defining the removable portion of the wrapper is at least 10 millimeters.

14. A container according to claim 12 in which the line of weakness comprises a line of perforations.

15. A container according to claim 1 wherein the one or more consumer goods is a plurality of smoking articles.

16. A container according to claim 2, wherein one or more parts of the wrapper that are visible upon opening the housing lid carry a portion of an overall indicia, and wherein another portion of the overall indicia is carried by the second part of the removable portion of the wrapper.

17. A container according to claim 16 in which the lid extends from the box along a hinge line across a back wall of the housing, in which the lid is moveable between an open position and a closed position in which a front wall of the lid and a front wall of the box together define a front wall of the housing opposite the back wall of the housing.

18. A container according to claim 2, wherein the second part of the removable portion of the wrapper underlies a front wall of the box.

19. A container according to claim 3, wherein the second part of the removable portion of the wrapper underlies a front wall of the box.

20. A container according to claim 2 in which the area of the second part of the removable portion of the wrapper is at least 10 percent of the area of the removable portion of the wrapper.

* * * * *